US010126688B2

(12) United States Patent
Tokoro et al.

(10) Patent No.: US 10,126,688 B2
(45) Date of Patent: Nov. 13, 2018

(54) TRANSFER UNIT AND IMAGE FORMING APPARATUS INCLUDING SAME

(71) Applicant: KYOCERA Document Solutions Inc., Osaka (JP)

(72) Inventors: Yoshitaka Tokoro, Osaka (JP); Yoshiaki Tashiro, Osaka (JP); Masafumi Miki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/933,141

(22) Filed: Mar. 22, 2018

(65) Prior Publication Data

US 2018/0284657 A1 Oct. 4, 2018

(30) Foreign Application Priority Data

Mar. 31, 2017 (JP) ..... 2017-071068

(51) Int. Cl.
*G03G 15/00* (2006.01)
*G03G 15/16* (2006.01)
*G03G 15/01* (2006.01)

(52) U.S. Cl.
CPC ..... *G03G 15/1615* (2013.01); *G03G 15/0131* (2013.01)

(58) Field of Classification Search
CPC ..... G03G 15/1615; G03G 15/757; G03G 21/1666
See application file for complete search history.

(56) References Cited

U.S. PATENT DOCUMENTS

2007/0059054 A1 3/2007 Furukawa ..... 399/302
2008/0240800 A1 10/2008 Furukawa ..... 399/302
2011/0293336 A1* 12/2011 Noso ..... G03G 15/1615 399/302
2012/0243913 A1* 9/2012 Murata ..... G03G 15/0875 399/263
2013/0264983 A1* 10/2013 Okumura ..... H02P 23/0045 318/400.26
2014/0153942 A1* 6/2014 Tokoro ..... G03G 15/0189 399/49
2016/0103404 A1* 4/2016 Hasegawa ..... G03G 15/1605 399/313

FOREIGN PATENT DOCUMENTS

JP 2007-79570 A 3/2007

* cited by examiner

*Primary Examiner* — Walter L Lindsay, Jr.
*Assistant Examiner* — Jessica L Eley
(74) *Attorney, Agent, or Firm* — Stein IP, LLC

(57) ABSTRACT

A transfer unit includes a transfer belt, transfer rollers, support members, moving members, a pinion gear, a sensor, and a light shielding plate that blocks or opens an optical path of the detection portion by rotation of a gear transmitting the drive force to the pinion gear. The light shielding plate includes a pulse portion in which a plurality of slits are formed, and at least one of a light shielding portion and a light transmitting portion formed adjacent to the pulse portion. A rotation amount of the gear is detected based on the number of the slits of the pulse portion that has passed the detection portion, and a reference position of the gear is detected based on timing when an edge of the light shielding portion blocks the detection portion or timing when an edge of the light transmitting portion opens the optical path of the detection portion.

9 Claims, 9 Drawing Sheets

TRANSFER UNIT AND IMAGE FORMING APPARATUS INCLUDING SAME

INCORPORATION BY REFERENCE

This application is based upon and claims the benefit of priority from the corresponding Japanese Patent Application No. 2017-71068 filed Mar. 31, 2017, the entire contents of which are hereby incorporated by reference.

BACKGROUND

The present disclosure relates to a transfer unit including an endless transfer belt, and a plurality of transfer rollers for transferring individual color toner images onto the transfer belt or a recording medium held and conveyed on the transfer belt, so as to be sequentially overlaid, and to an image forming apparatus equipped with the transfer unit.

Conventionally, various image forming apparatuses are proposed, and among them there is a tandem color image forming apparatus in which a plurality of image forming portions sequentially overlays individual color toner images so as to form a full color image. Further, the tandem color image forming apparatuses include two types: one is a direct transfer type in which toner images formed by individual image forming portions are transferred onto a recording medium conveyed on the endless transfer belt, and the other is an intermediate transfer type in which a plurality of image forming portions sequentially overlay (primarily transfer) toner images on an endless intermediate transfer belt, and then the toner images are transferred (secondarily transferred) onto a recording medium at one time.

In a monochrome mode of the tandem color image forming apparatus, in which a monochrome image is output, only black toner is used for performing image formation. In this monochrome mode, if image carriers of the image forming portions of yellow, magenta, and cyan other than black are kept in contact with the transfer belt, the transfer belt or the recording medium becomes dirty due to the contact with the yellow, magenta, and cyan image carriers, or a driving torque of the transfer belt is unnecessarily increased as a malfunction. Therefore, there is known an image forming apparatus that can switch between a contact mode and a standby mode. In the contact mode, the yellow, magenta, cyan, and black image carriers contact with some of or all the transfer rollers via the intermediate transfer belt. In the standby mode, all the transfer rollers are separated from them.

As described above, when performing a contacting or separating operation of the transfer roller, conventionally, a drive time of a drive motor for moving the transfer roller in a reciprocating manner between a contact position and a separation position is controlled so that the transfer roller is stopped at the contact position or the separation position. Therefore, a stop position of the transfer roller may vary, and hence a press contact state of the transfer roller to the photosensitive drum varies so as to affect a transfer performance of a toner image as a problem.

Accordingly, there is proposed a method of accurately stopping the transfer roller at the contact position or the separation position. For example, there is known an image forming apparatus having a structure for moving a primary transfer roller in a reciprocating manner in accordance with a rotation of a cam so that the transfer belt contacts with or separates from the photosensitive drum, in which a sensor for optically detects a rotation position of the cam.

SUMMARY

A transfer unit according to one aspect of the present disclosure includes a transfer belt, a plurality of transfer rollers, a plurality of pairs of support members, a pair of moving members, a pinion gear, a sensor, and a light shielding plate. The transfer belt is endless and moves along a plurality of image forming portions. The transfer rollers are respectively disposed to face image carriers disposed in the image forming portions, via the transfer belt, so as to transfer toner images formed on the image carriers onto the transfer belt or a recording medium held on the transfer belt. The support members support both end portions of rotation shafts of the plurality of transfer rollers in a rotatable manner and are capable of reciprocatingly moving in a contact or separate direction with respect to the transfer belt. The moving members reciprocatingly move the support members in the contact or separate direction with respect to the transfer belt. The pinion gear transmits a drive force to the moving member. The sensor includes a detection portion constituting of a light emission portion and a light reception portion. The light shielding plate is formed integrally to a gear for transmitting the drive force to the pinion gear, and includes a pulse portion in which a plurality of slits are formed at uniform intervals, and at least one of a light shielding portion and a light transmitting portion formed adjacent to the pulse portion. A rotation amount of the gear is detected based on the number of the slits of the pulse portion that has passed the detection portion, and a reference position of the gear is detected based on timing when an edge of the light shielding portion passes the detection portion so as to block the optical path of the detection portion or timing when an edge of the light transmitting portion passes the detection portion so as to open the optical path of the detection portion.

Other objects of the present disclosure and specific advantages obtained by the present disclosure will become more apparent from the description of embodiments given below.

DETAILED DESCRIPTION

Figure 1:
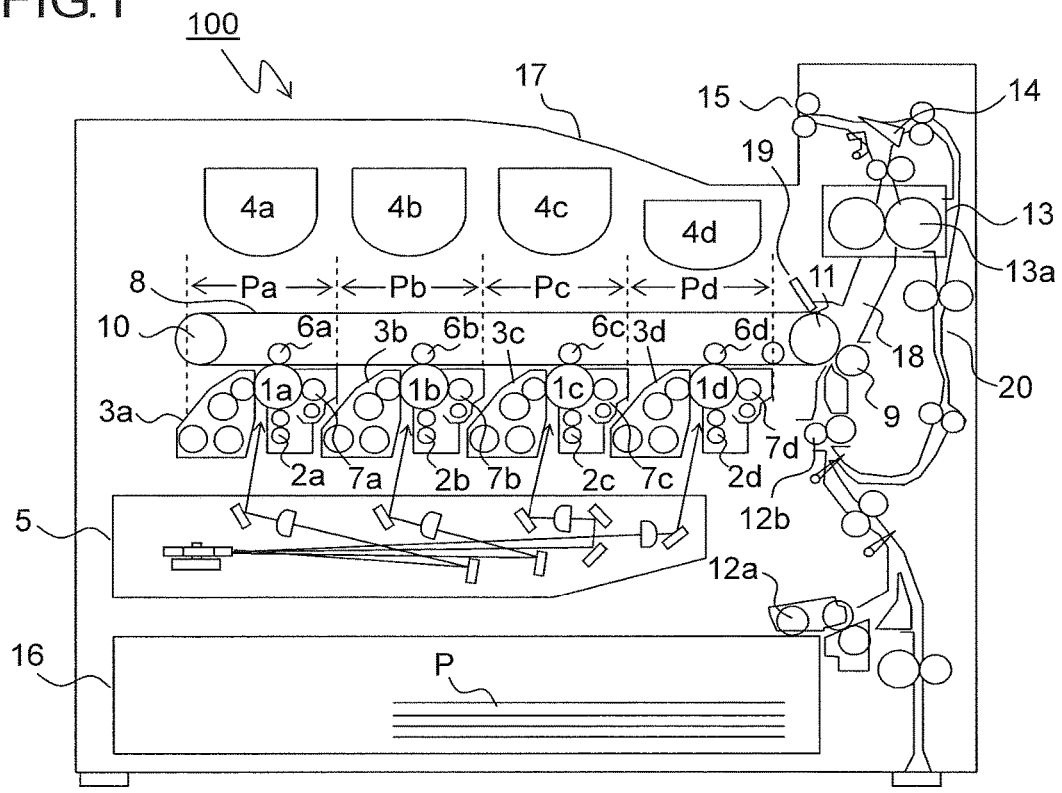
FIG. 1 is a schematic side view showing a structure of a color printer equipped with an intermediate transfer unit of the present disclosure.

Hereinafter, with reference to the drawings, embodiments of the present disclosure are described. FIG. 1 is a schematic cross-sectional view of an image forming apparatus equipped with an intermediate transfer unit of the present disclosure and shows a tandem type color image forming apparatus. In a main body of a color printer 100, four image forming portions Pa, Pb, Pc, and Pd are disposed in order from an upstream side in a conveying direction (left side in FIG. 1). These image forming portions Pa to Pd are disposed corresponding to four different color images (yellow, cyan, magenta, and black images), and sequentially form yellow, cyan, magenta, and black images by processes of electrifying, exposing, developing, and transferring.

These image forming portions Pa to Pd are respectively provided with photosensitive drums 1*a*, 1*b*, 1*c*, and 1*d* for carrying visual images (toner images) of individual colors. Further, an intermediate transfer belt 8, which is turned in a counterclockwise direction in FIG. 1 by a driving device (not shown), is disposed adjacent to the image forming portions Pa to Pd.

When image data is input from a host apparatus such as a personal computer, chargers 2*a* to 2*d* first electrify surfaces of the photosensitive drums 1*a* to 1*d*, uniformly and respectively. Next, an exposing device 5 emits light according to the image data so as to form electrostatic latent images according to the image data on the photosensitive drums 1*a* to 1*d*, respectively. Each of developing devices 3*a* to 3*d* is filled with a predetermined amount of two-component developer (hereinafter also referred to simply as developer) containing each of cyan, magenta, yellow, and black color toners from a toner container (not shown). Each of the developing devices 3*a* to 3*d* supplies toner in the developer onto each of the photosensitive drums 1*a* to 1*d* so as to electrostatically attach to the same. In this way, toner images are formed corresponding to the electrostatic latent images formed by exposure with the exposing device 5.

Further, each of primary transfer rollers 6*a* to 6*d* applies an electric field of a predetermined transfer voltage between the each of the primary transfer rollers 6*a* to 6*d* and corresponding one of photosensitive drums 1*a* to 1*d*, and the cyan, magenta, yellow, and black toner images on the photosensitive drums 1*a* to 1*d* are primarily transferred onto the intermediate transfer belt 8. After the primary transfer, toner and the like remaining on the surfaces of the photosensitive drums 1*a* to 1*d* are removed by cleaning devices 7*a* to 7*d*.

Paper sheets P onto which the toner images are transferred are housed in a paper sheet cassette 16 disposed in a lower part of the color printer 100. The paper sheet P housed in the paper sheet cassette 16 is conveyed to a nip portion (secondary transfer nip portion) between the intermediate transfer belt 8 and a secondary transfer roller 9 disposed adjacent to the intermediate transfer belt 8, via a sheet feed roller 12*a* and a registration roller pair 12*b*, at a predetermined timing. The paper sheet P with the secondarily transferred toner image is conveyed to a fixing portion 13. After the secondary transfer, toner and the like remaining on the surface of the intermediate transfer belt 8 are removed by a belt cleaning device 19.

The paper sheet P conveyed to the fixing portion 13 is heated and pressed by a fixing roller pair 13*a*, and the toner image is fixed to the surface of the paper sheet P so that a predetermined full color image is formed. The paper sheet P with the formed full color image is discharged by a discharge roller pair 15 onto a discharge tray 17 as it is (or after being sent to a reverse conveying path 18 by a branching portion 14 and after images are formed on both sides).

Figure 2:
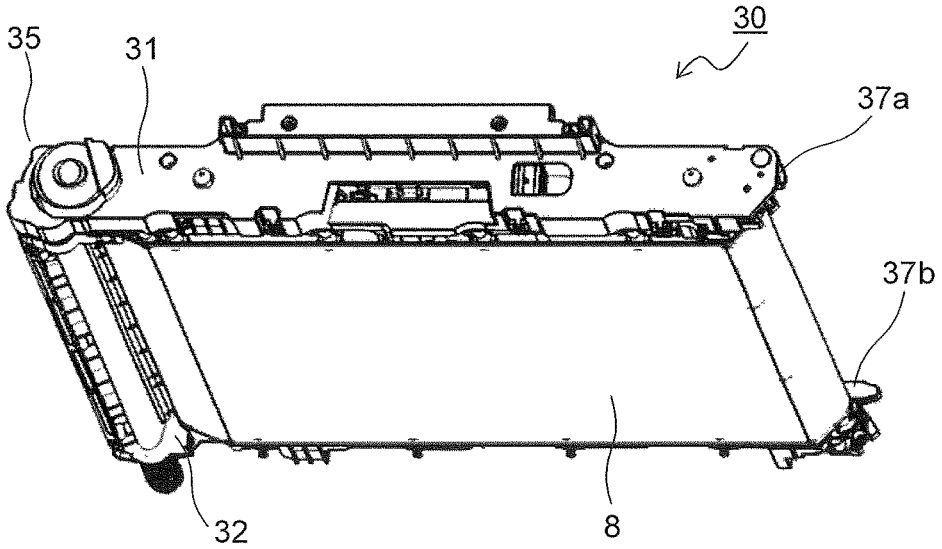
FIG. 2 is an external perspective view of the intermediate transfer unit viewed from below according to a first embodiment of the present disclosure.
Figure 3:
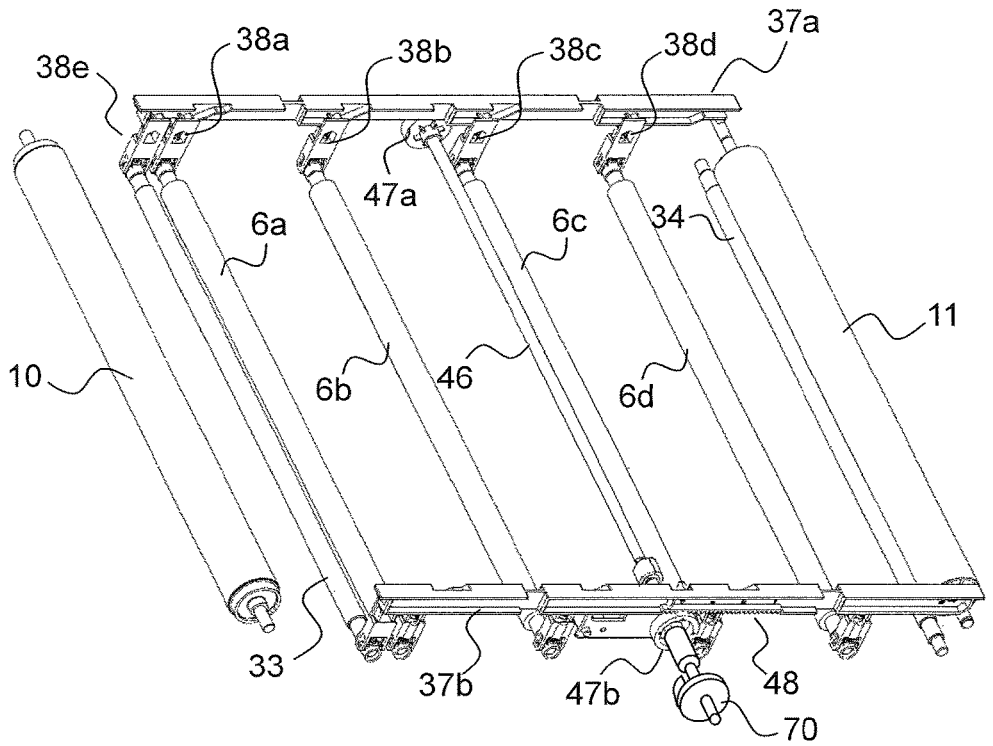
FIG. 3 is a perspective view showing an internal structure of the intermediate transfer unit of the first embodiment.

FIG. 2 is an external perspective view of an intermediate transfer unit 30 mounted in the color printer 100 shown in FIG. 1, viewed from below, according to a first embodiment of the present disclosure, and FIG. 3 is a perspective view showing an internal structure of the intermediate transfer unit 30 of the first embodiment. The same part as in FIG. 1 is denoted by the same numeral or symbol, and description thereof is omitted.

The intermediate transfer unit 30 includes a unit main body 35 constituted of two side face frames 31 and 32 and an upper face frame (not shown), the primary transfer rollers 6*a* to 6*d*, a tension roller 10, a drive roller 11, a backup roller 33, a guide roller 34, which are supported between the side face frames 31 and 32, and endless the intermediate transfer belt 8 stretched around these rollers, and the like.

The side face frames 31 and 32 support sliders 37*a* and 37*b* in a slidable manner in a horizontal direction. Both end portions of rotation shafts of the primary transfer rollers 6*a* to 6*d* and the backup roller 33 are supported by bearing holders 38*a* to 38*e* in a rotatable manner, and the bearing holders 38*a* to 38*e* are supported by the sliders 37*a* and 37*b* in a movable manner in an up/down direction. In addition, the tension roller 10, the drive roller 11, and the guide roller 34 are supported by the side face frames 31 and 32 in a rotatable manner.

A shaft 46 is disposed inside the intermediate transfer unit 30, and pinion gears 47*a* and 47*b* are fixed to both end portions of the shaft 46. The shaft 46 penetrates the side face frame 32 (see FIG. 2) so as to protrude to the outside of the intermediate transfer unit 30, and a drive input gear 70 is fixed to a distal end portion or its vicinity. A rotation drive force is transmitted from a drive motor (not shown) disposed on a main body side of the color printer 100 to the drive input gear 70 via a gear train (not shown).

The pinion gears 47*a* and 47*b* are disposed at positions for engaging with racks 48 formed on lower surfaces of the sliders 37*a* and 37*b*, respectively. By forward and reverse rotation of the pinion gears 47*a* and 47*b*, the sliders 37*a* and 37*b* can move horizontally in a reciprocating manner. The shaft 46 and the pinion gears 47*a* and 47*b* constitute a slider drive mechanism for moving the sliders 37*a* and 37*b* in a reciprocating manner.

Figure 4:
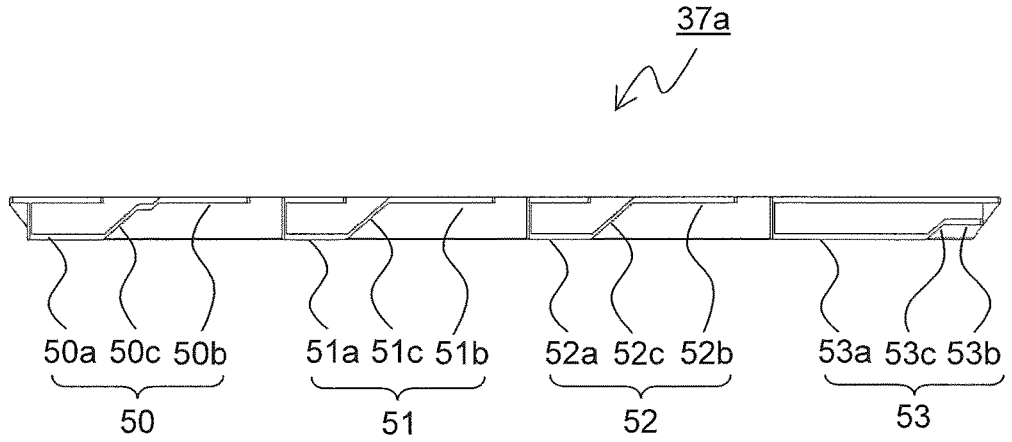
FIG. 4 is a side view of a slider used in the intermediate transfer unit of the first embodiment, viewed from inside of the intermediate transfer unit.

FIG. 4 is a side view of the slider 37*a* used in the intermediate transfer unit 30 of the first embodiment, viewed from inside of the intermediate transfer unit 30. Note that the slider 37*b* has the same structure as the slider 37*a* except that they are bilaterally symmetrical with each other, and hence description thereof is omitted. Four step ribs 50 to 53 including the first step rib 50, the second step rib 51, the third step rib 52, and the fourth step rib 53 are formed on an inner side surface of the slider 37*a*. Each of the step ribs 50 to 53 is constituted of each of lower step portions 50*a* to 53*a*, each of upper step portions 50*b* to 53*b*, and each of inclined portions 50*c* to 53*c* connecting the lower step portions 50*a* to 53*a* and the upper step portions 50*b* to 53*b*, respectively.

Figure 5:
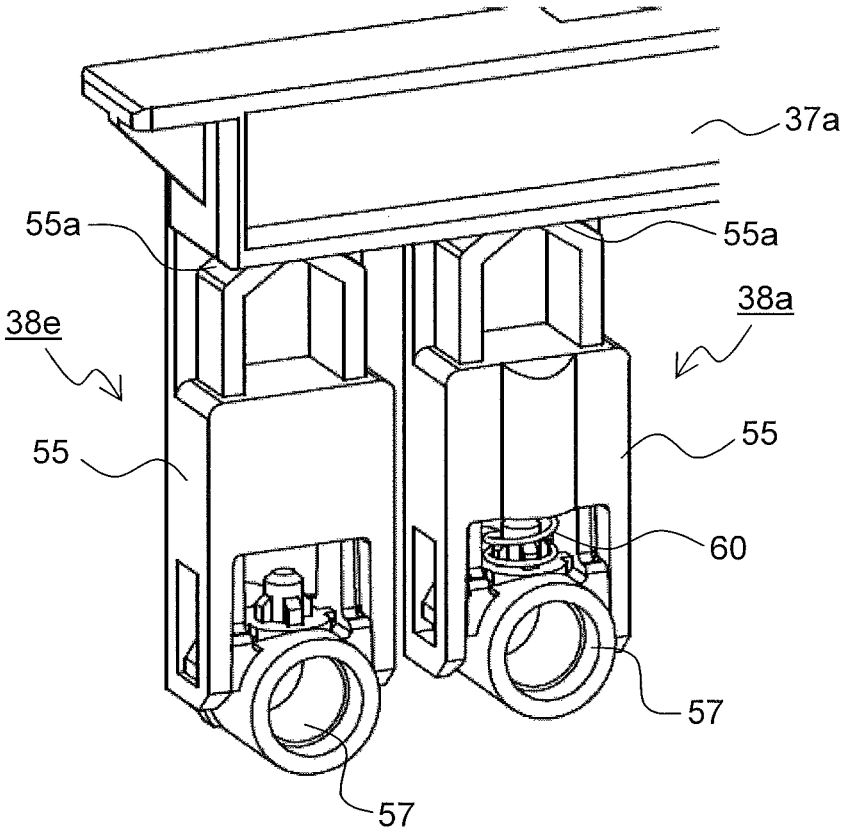
FIG. 5 is a partial enlarged diagram of a bearing holder of a primary transfer roller and a bearing holder of a backup roller, viewed from inside of the intermediate transfer unit, and is a diagram showing a state where the primary transfer roller and the backup roller are contacted with an intermediate transfer belt.
Figure 6:
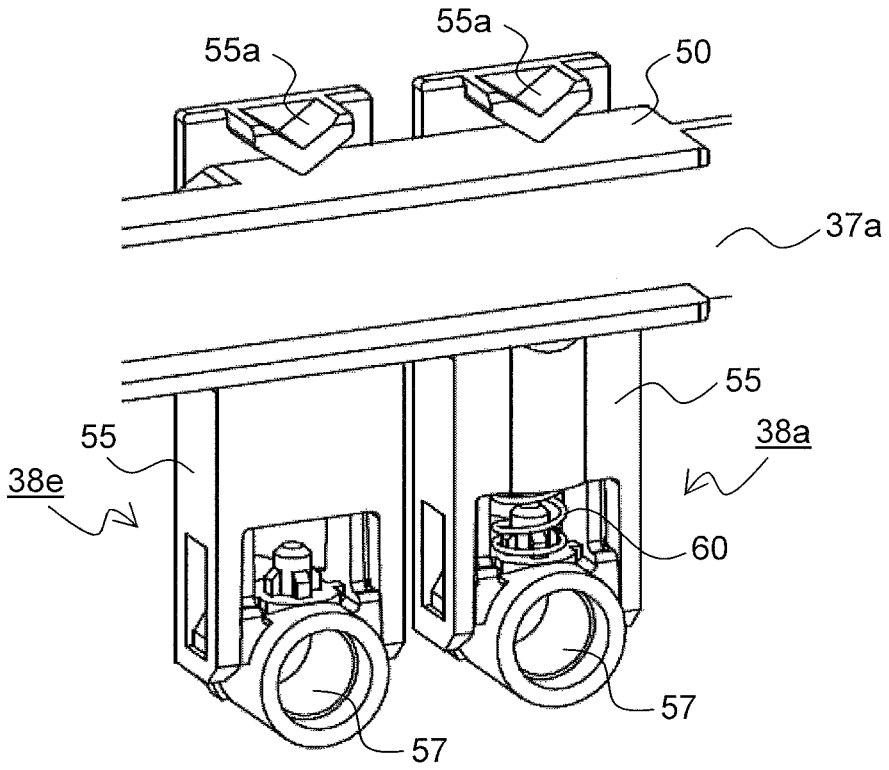
FIG. 6 is a partial enlarged diagram of the bearing holder of the primary transfer roller and the bearing holder of the backup roller, viewed from inside of the intermediate transfer unit, and is a diagram showing a state where the primary transfer roller and the backup roller are separated from the intermediate transfer belt.

FIGS. 5 and 6 are partial enlarged diagrams of the bearing holder 38*a* of the primary transfer roller 6*a* and the bearing holder 38*e* of the backup roller 33, viewed from inside of the intermediate transfer unit 30. Note that FIG. 5 shows a state where the primary transfer roller 6*a* and the backup roller 33 are contacted with the intermediate transfer belt 8. FIG. 6 shows a state where the primary transfer roller 6*a* and the backup roller 33 are separated from the intermediate transfer belt 8. In addition, bearing holders 38*b* to 38*d* have completely the same structure as the bearing holder 38*a*, and hence description thereof is omitted.

The bearing holder 38*a* is constituted of a holder main body 55, a bearing portion 57 supported by the holder main body 55 in a vertically movable manner, and a coil spring 60 disposed between the holder main body 55 and the bearing portion 57. The bearing portion 57 is biased by a biasing force of the coil spring 60 in a direction separating from the holder main body 55 (in a downward direction). The bearing holder 38*e* has a structure so that the bearing portion 57 is fixed at a lower end position with respect to the holder main body 55, and is not provided with the coil spring 60.

In addition, an upper end portion of the holder main body 55 is provided with a sandwiching portion 55*a* constituted of a pair of V-shaped ribs arranged so that vertex parts thereof face each other. The bearing holders 38*a* and 38*e* are arranged so that the sandwiching portion 55*a* sandwiches the first step ribs 50 of the sliders 37*a* and 37*b* from above and below. In this way, the bearing holders 38*a* and 38*e* are supported by the first step ribs 50 of the sliders 37*a* and 37*b* in a slidable manner.

In the same manner, the bearing holder 38*b* of the primary transfer roller 6*b* is supported by the second step rib 51, the bearing holder 38*c* of the primary transfer roller 6*c* is supported by the third step rib 52, and the bearing holder 38*d* of the primary transfer roller 6*d* is supported by the fourth step rib 53, respectively in a slidable manner.

Figure 7:
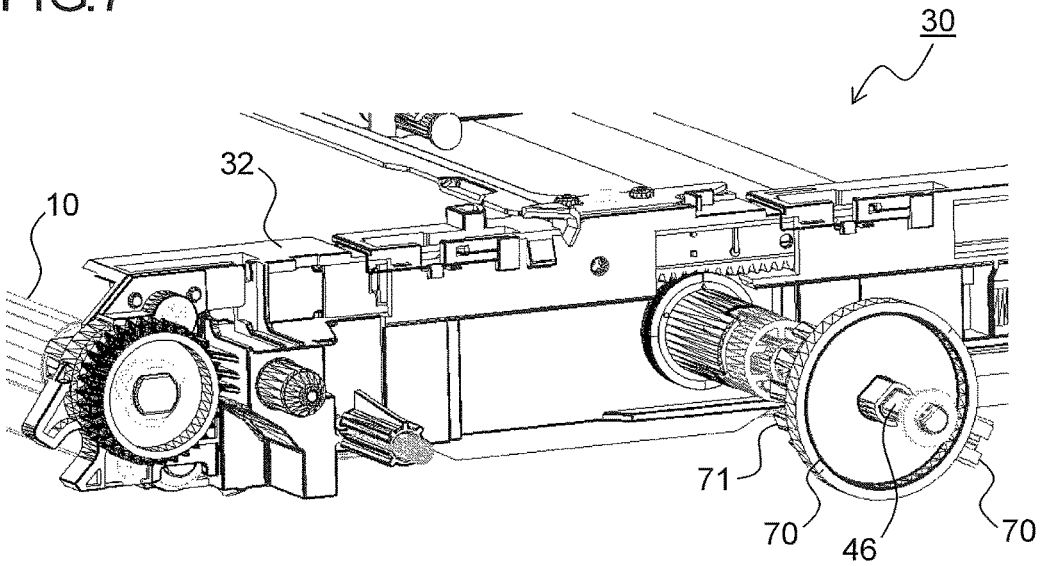
FIG. 7 is an enlarged perspective view of a drive input gear and its periphery in the intermediate transfer unit of the first embodiment.
Figure 8:
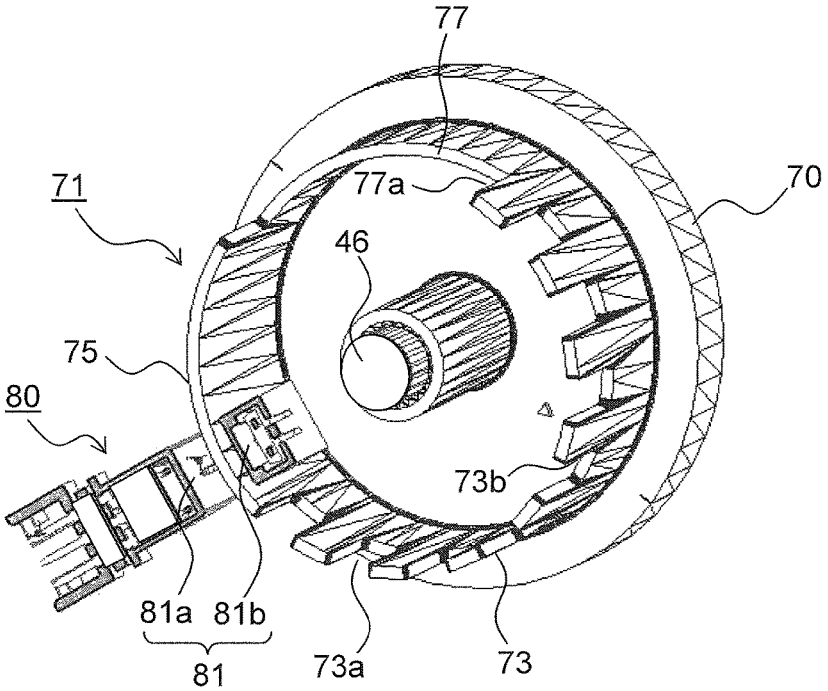
FIG. 8 is a perspective view of the drive input gear and a gear position detection sensor viewed from a side face frame side (paper surface depth side of FIG. 7).
Figure 9:
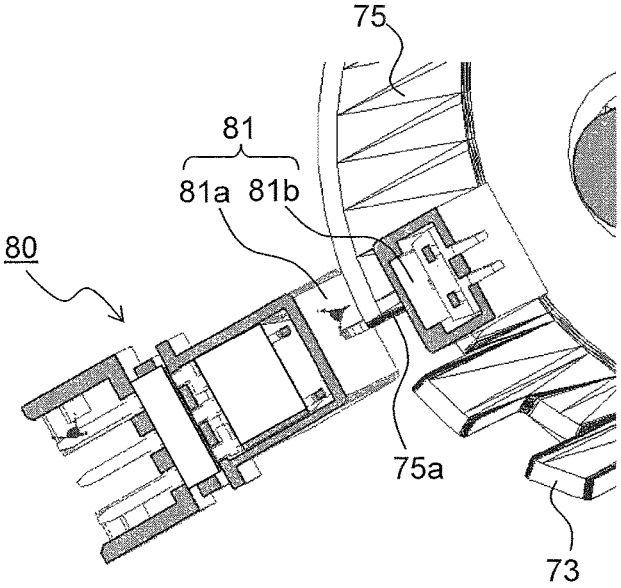
FIG. 9 is an enlarged perspective view of the gear position detection sensor and its vicinity in FIG. 8.

FIG. 7 is an enlarged perspective view of the drive input gear 70 and its periphery of the intermediate transfer unit 30 of the first embodiment. FIG. 8 is a perspective view of the drive input gear 70 and a gear position detection sensor 80 viewed from the side face frame 32 side (paper surface depth side in FIG. 7), and FIG. 9 is an enlarged perspective view of the gear position detection sensor 80 and its vicinity in FIG. 8.

By rotating a drive motor provided to the main body side of the color printer 100 in forward and reverse directions by a predetermined amount, the drive input gear 70 also rotates in forward and reverse directions by a predetermined amount. When the drive input gear 70 rotates, the pinion gears 47*a* and 47*b* (see FIG. 3) fixed to the shaft 46 also rotates in forward and reverse directions by a predetermined amount, and hence the sliders 37*a* and 37*b* having the racks 48 engaging with the pinion gears 47*a* and 47*b* (see FIG. 3) also move in a left/right direction in FIG. 3. In this way, as described above, positions of the primary transfer rollers 6*a* to 6*d* are switched to the standby mode, the monochrome mode (first mode), or the color mode (second mode).

As shown in FIG. 8, a light shielding plate 71 is integrally formed in the drive input gear 70. The light shielding plate 71 protrudes in a circular shape from a position closer to inside in a radial direction than an outer peripheral edge of the drive input gear 70 toward the side face frame 32. The light shielding plate 71 includes a pulse portion 73 in which a plurality of slits 73*a* are formed at uniform intervals, and a light shielding portion 75 and a light transmitting portion 77 that are disposed adjacent to both sides of the pulse portion 73.

In addition, the gear position detection sensor 80, which detects a home position and a gear position (rotation angle) of the drive input gear 70, is disposed in a vicinity of the drive input gear 70. The gear position detection sensor 80 is a photointerrupter (PI) sensor and is disposed so that a U-shaped detection portion 81 including a light emission portion 81*a* and a light reception portion 81*b* sandwiches the light shielding plate 71 from front and rear.

When the drive input gear 70 rotates, the light shielding plate 71 rotates in the same direction as the drive input gear 70. Further, when the slits 73*a* of the pulse portion 73 pass through the detection portion 81, a light reception signal level of the detection portion 81 is switched between LOW level (OFF state) and HIGH level (ON state) at constant timings. By detecting timings at which the light reception signal level is switched, the rotation angle of the light shielding plate 71 is detected, and based on it, a position of the drive input gear 70 (rotation angle thereof) can be detected.

Figure 10:
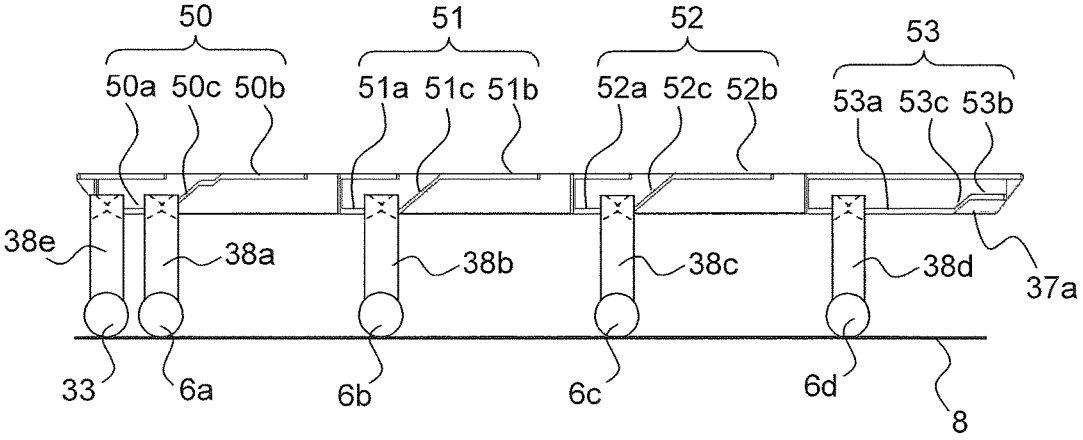
FIG. 10 is a side view showing arrangement of the slider, the bearing holder, the primary transfer roller, and the backup roller in a color mode.

Next, operations of the primary transfer rollers 6*a* to 6*d* and the backup roller 33 in the intermediate transfer unit 30 of this embodiment are described. FIG. 10 is a side view showing positions of the slider 37*a*, the bearing holders 38*a* to 38*e*, the primary transfer rollers 6*a* to 6*d*, and the backup roller 33 in the color mode. Note that although the tension roller 10, the drive roller 11, the guide roller 34, and the slider 37*b* are not shown, positions of the rollers and the slider 37*b* in the color mode are shown in FIG. 3, and hence FIG. 3 is referred to if necessary for description.

In the color mode for outputting a color image, image formation is performed using the four image forming portions Pa to Pd, and hence the four primary transfer rollers 6*a* to 6*d* are made to press-contact with the photosensitive drums 1*a* to 1*d*, respectively, via the intermediate transfer belt 8. In addition, it is necessary to position the backup roller 33 at a position such that the intermediate transfer belt 8 is pressed toward the photosensitive drums 1*a* to 1*d*.

Therefore, the pinion gears 47*a* and 47*b* are rotated in a predetermined direction (in a clockwise direction in FIG. 3) by a predetermined angle so that the sliders 37*a* and 37*b* slide in the right direction. Thus, as shown in FIG. 10, the bearing holders 38*a* to 38*e* are positioned at the lower step portions 50*a* to 53*a* of the step ribs 50 to 53, respectively.

Specifically, as shown in FIG. 9, the detection portion 81 of the gear position detection sensor 80 detects passing of an edge 75*a* of the light shielding portion 75 formed on the light shielding plate 71, and the light reception signal level of the detection portion 81 is switched from HIGH level (ON state) to LOW level (OFF state). Then, the light reception signal level of the detection portion 81 is maintained at LOW level. Therefore, the drive motor is stopped at a time point when the light reception signal level of the detection portion 81 has been at LOW level for a predetermined time, and hence the bearing holders 38*a* to 38*e* are positioned at the lower step portions 50*a* to 53*a* of the first to fourth step ribs 50 to 53, respectively. Note that the rotation position (rotation angle) of the drive input gear 70 at this time point is set as a reference position.

In this case, the primary transfer rollers 6*a* to 6*d* and the backup roller 33 contact with the intermediate transfer belt 8, but as shown in FIG. 5, a drag force from the intermediate transfer belt 8 changes compression lengths of the coil springs 60 in the bearing holders 38*a* to 38*d*. Therefore, a gap is generated between the holder main body 55 and the bearing portion 57, and the primary transfer rollers 6*a* to 6*d* are made to press-contact with the photosensitive drums 1*a* to 1*d* via the intermediate transfer belt 8 at a predetermined pressure. In addition, the backup roller 33 presses the intermediate transfer belt 8 downward at a predetermined position. In this way, the bearing holders 38*a* to 38*e* move downward so that the four primary transfer rollers 6*a* to 6*d* and the backup roller 33 are made to press-contact with the intermediate transfer belt 8 as the color mode.

Figure 11:
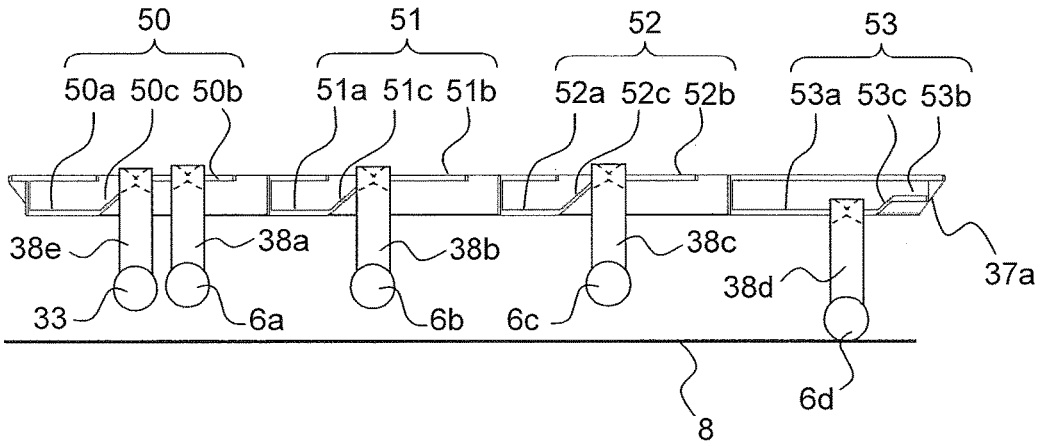
FIG. 11 is a side view showing arrangement of the slider, the bearing holder, the primary transfer roller, and the backup roller in a monochrome mode.

FIG. 11 is a side view showing positions of the slider 37*a*, the bearing holders 38*a* to 38*e*, the primary transfer rollers 6*a* to 6*d*, and the backup roller 33 in the monochrome mode. In the monochrome mode for outputting a monochrome image, image formation is performed using only the black image forming portion Pd, and therefore it is necessary to allow only the primary transfer roller 6*d* to press-contact with the photosensitive drum 1*d* via the intermediate transfer belt 8. Therefore, the pinion gears 47*a* and 47*b* are rotated in the reverse direction (the counterclockwise direction in FIG. 3) by a predetermined angle so that the sliders 37*a* and 37*b* are moved to slide leftward from the state of FIG. 10 by a predetermined amount.

When the pinion gears 47*a* and 47*b* are rotated in the reverse direction in the state where the drive input gear 70 is at the reference position, the drive input gear 70 fixed to the shaft 46 rotates in the clockwise direction in FIG. 8. Then, the number of switching times of the light reception signal level from LOW level to HIGH level due to passing of the slits 73*a* of the pulse portion 73 is counted. For example, the drive of the drive motor is continued until the light reception signal level of the detection portion 81 is switched from LOW level to HIGH level five times and passing of the edge 73*b* is detected.

As a result, the pinion gears 47*a* and 47*b* rotate in the reverse direction by a predetermined angle, and hence the bearing holders 38*a* to 38*e* moves from the lower step portions 50*a* to 52*a* to the upper step portions 50*b* to 52*b* via the inclined portions 50*c* to 52*c* of the first to third step ribs 50 to 52. On the other hand, the bearing holder 38*d* stays at the lower step portion 53*a* of the fourth step rib 53. In this way, the mode is switched to the monochrome mode in which the bearing holders 38*a* to 38*c* are moved upward while only the primary transfer roller 6*d* is made to press-contact with the intermediate transfer belt 8.

In the monochrome mode, the primary transfer rollers 6*a* to 6*c* and the backup roller 33 separate from the intermediate transfer belt 8, and hence it is possible to prevent the intermediate transfer belt 8 from being contaminated by residual toner on the surfaces of the photosensitive drums 1*a* to 1*c*. In addition, it is also avoided that a driving torque of the drive roller 11 for rotating the intermediate transfer belt 8 is unnecessarily increased.

Figure 12:
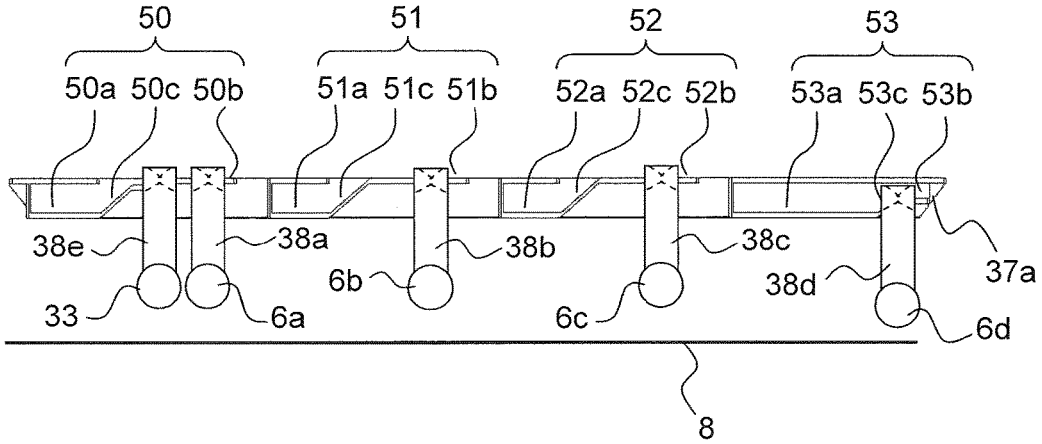
FIG. 12 is a side view showing arrangement of the slider, the bearing holder, the primary transfer roller, and the backup roller in a standby mode.

FIG. 12 is a side view showing positions of the slider 37*a*, the bearing holders 38*a* to 38*e*, the primary transfer rollers 6*a* to 6*d*, and the backup roller 33 in the standby mode. In the standby mode in which an image is not output, the pinion gears 47*a* and 47*b* are further rotated in the reverse direction so that the sliders 37*a* and 37*b* are moved to slide leftward from the state of FIG. 11 by a predetermined amount.

When the drive input gear 70 is further rotated from the state of FIG. 11, the light transmitting portion 77 adjacent to the pulse portion 73 passes the detection portion 81. In this case, the light reception signal level of the detection portion 81 is maintained at HIGH level (ON state). In this position, the drive of the drive motor is stopped, and thus the bearing holders 38*d* and 38*e* move to the upper step portion 53*b* of the fourth step rib 53 and the upper step portion 50*b* of the first step rib 50, respectively. In other words, the drive motor is stopped at a time point when the light reception signal level of the detection portion 81 has been at HIGH level for a predetermined time, all the bearing holders 38*a* to 38*e* move to the upper step portions 50*b* to 53*b* as shown in FIG. 12, and the mode is switched to the standby mode in which the four primary transfer rollers 6*a* to 6*d* and the backup roller 33 are separated from the intermediate transfer belt 8.

In the standby mode, because the primary transfer rollers 6*a* to 6*d* and the backup roller 33 are separated from the intermediate transfer belt 8, the tension applied to the intermediate transfer belt 8 is loosen, and it is possible to prevent the intermediate transfer belt 8 from deforming or expanding.

Note that when switching from the standby mode to the color mode, the sliders 37*a* and 37*b* and the bearing holders 38*a* to 38*e* are operated in a manner opposite to that described above. In addition, the procedure for detecting the rotation angle of the drive input gear 70 by the gear position detection sensor 80 is also opposite to that described above.

With the structure of described above, because the gear position detection sensor 80 detects the light shielding plate 71 formed integrally to the drive input gear 70, it is possible to detect rotation amounts (rotation angles) of the pinion gears 47*a* and 47*b* fixed to the same shaft as the drive input gear 70 (shaft 46). In this way, the movement amount and direction of the sliders 37*a* and 37*b* can be also controlled accurately.

In addition, the light shielding plate 71 is provided with the pulse portion 73, the light shielding portion 75, and the light transmitting portion 77, and the rotation position (rotation angle) of the drive input gear 70 when the edge 75*a* of the light shielding portion 75 passes the detection portion 81 of the gear position detection sensor 80 is set as the reference position. Thus, the drive input gear 70 can be stopped at the reference position accurately. In other words, single the gear position detection sensor 80 can detect both the reference position and the rotation angle of the drive input gear 70. Therefore, it is not necessary to use a plurality of expensive PI sensors, and an inexpensive DC brush motor can be used as the drive motor. Thus, it is advantageous in cost.

Note that the rotation position (rotation angle) of the drive input gear 70 when the edge 75*a* of the light shielding portion 75 passes the detection portion 81 is set as the reference position in the embodiment described above, but the reference position may be set as the rotation position (rotation angle) of the drive input gear 70 when the edge 77*a* of the light transmitting portion 77 (see FIG. 8) passes the detection portion 81. In addition, the mode is set to the color mode when the drive input gear 70 is at the reference position in the embodiment described above, but it is possible that the mode is set to the standby mode when the drive input gear 70 is at the reference position.

Figure 13:
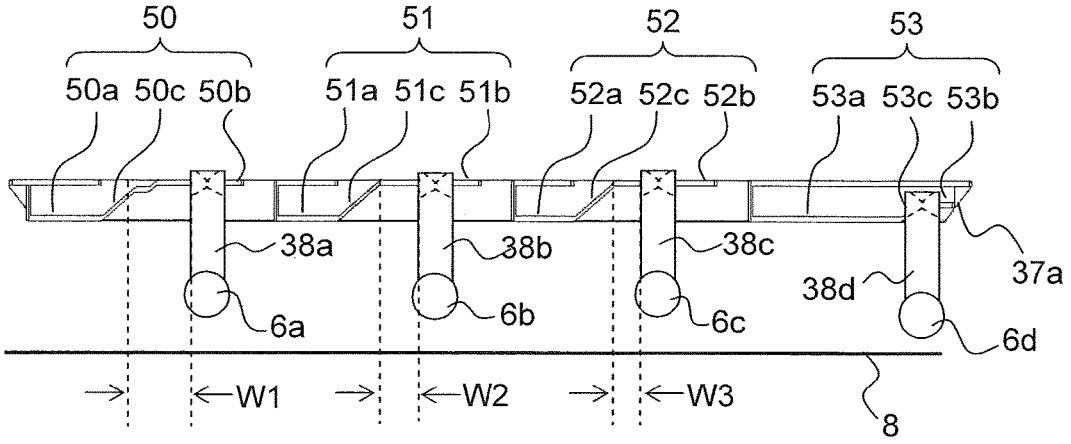
FIG. 13 is a side view of the slider and the bearing holder used in the intermediate transfer unit according to a second embodiment of the present disclosure, viewed from inside of the intermediate transfer unit.

FIG. 13 is a side view of the slider 37*a* and the bearing holders 38*a* to 38*d* used in the intermediate transfer unit 30 according to a second embodiment of the present disclosure, viewed from inside of the intermediate transfer unit 30. FIG. 13 shows positions of the bearing holders 38*a* to 38*d* in the standby mode, and the bearing holder 38*e* for supporting the backup roller 33 is not shown. In addition, the slider 37*a* and the bearing holders 38*a* to 38*d* on the slider 37*a* side are described in this description, but the slider 37*b* and the bearing holders 38*a* to 38*d* on the slider 37*b* side have the same structure except that they are bilaterally symmetrical with each other.

As shown in FIG. 13, separation distances W1 to W3 in the horizontal direction between each of the bearing holders 38*a* to 38*c* and each of the inclined portions 50*c* to 52*c* of the first to third step ribs 50 to 52 in the standby mode are different from each other. Specifically, the separation distances W1 to W3 satisfy the relationship of W1>W2>W3. In addition, the difference among the separation distances W1 to W3 is larger than a pitch of rack teeth of the rack 48.

When switching from the standby mode to the monochrome mode, the sliders 37*a* and 37*b* are moved to slide in the right direction by a predetermined amount from the state of FIG. 13, and the bearing holder 38*d* moves downward along the inclined portion 53*c* of the fourth step rib 53 so as to be positioned at the lower step portion 53*a*. On the other hand, the bearing holders 38*a* to 38*c* do not reach the inclined portions 50*c* to 52*c*, and keeps the upper step portions 50*b* to 52*b*, respectively. In this way, the primary transfer roller 6*d* is made to press-contact with the intermediate transfer belt 8.

When switching from the monochrome mode to the color mode, the sliders 37*a* and 37*b* are made to slide in the right direction further than in the monochrome mode, and hence the bearing holders 38*a* to 38*c* are moved downward along the inclined portions 50*c* to 52*c* of the first to third step ribs 50 to 52 so as to be positioned at the lower step portions 50*a* to 52*a*, respectively. In this way, the primary transfer rollers 6*a* to 6*c* are made to press-contact with the intermediate transfer belt 8. In this way, all the primary transfer rollers 6*a* to 6*d* are made to press-contact with the intermediate transfer belt 8.

Figure 14:
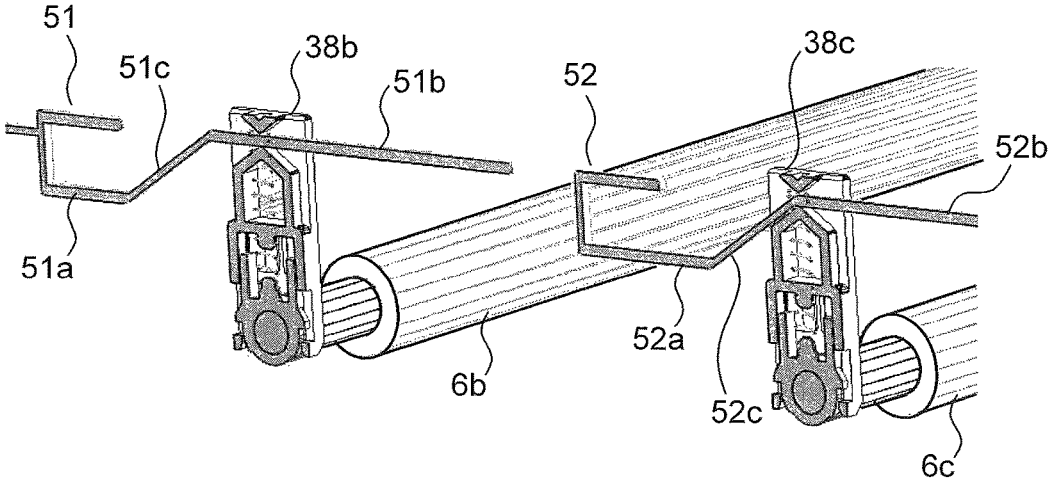
FIG. 14 is a perspective view showing a positional relationship between the bearing holder and a second step rib, and between the bearing holder and a third step rib used in the intermediate transfer unit of the second embodiment.

In this case, because the separation distances W1 to W3 satisfy W1>W2>W3, when the slider 37*a* is moved to slide in the right direction in FIG. 13, the bearing holders 38*a* to 38*c* respectively reach the inclined portions 50*c* to 52*c* with time differences in the order of the bearing holders 38*c*, 38*b*, and 38*a*. For example, as shown in FIG. 14, the bearing holder 38*c* for supporting the primary transfer roller 6*c* reaches the inclined portion 52*c* of the third step rib 52 before the bearing holder 38*b* for supporting the primary transfer roller 6*b* reaches the inclined portion 51*c* of the second step rib 51. Further, the bearing holders 38*a* to 38*c* respectively move to the lower step portions 52*a*, 51*a* and 50*a* along the inclined portion 52*c*, 51*c*, 50*c* in the order of the bearing holders 38*c*, 38*b*, and 38*a*. As a result, the primary transfer rollers 6*a* to 6*c* are made to press-contact with the intermediate transfer belt 8 with time differences between them in the order of the primary transfer roller 6*c*, 6*b*, and 6*a*.

With the structure of described above, when switching to the color mode, the primary transfer rollers 6*a* to 6*c* are made to press-contact with the intermediate transfer belt 8 with time differences, and hence it is possible to prevent the intermediate transfer belt 8 from being rapidly applied with a large load. Therefore, time until the rotation behavior of the intermediate transfer belt 8 is stabilized can be shortened, and hence the print wait time can be shortened.

In addition, because the print wait time is shortened, it is possible to switch to the standby mode frequently (e.g. after every end of a job). Therefore, a load applied to the intermediate transfer belt 8 can be released frequently, and hence longer life of the intermediate transfer belt 8 can be achieved.

Note that the pair of bearing holders 38*a* to 38*c* for supporting the both end portions of the primary transfer rollers 6*a* to 6*c* are moved to the lower step portions 50*a* to 52*a* at the same timing in the embodiment described above, but for example, each of the first to third step ribs 50 to 52 (separation distances W1 to W3) may have different shapes between the slider 37*a* and the slider 37*b*, so that each of the bearing holders 38*a* to 38*c* for supporting one end portion of the primary transfer rollers 6*a* to 6*d* and each of the bearing holders 38*a* to 38*c* for supporting the other end portion of the same are moved to the lower step portions 50*a* to 52*a* at different timings from each other.

In this case, one end portion and the other end portion of the primary transfer rollers 6*a* to 6*d* are made to press-contact with the intermediate transfer belt 8 at different timings from each other. In this way, it is possible to effectively prevent the intermediate transfer belt 8 from being rapidly applied with a large load.

In addition, as described above, the primary transfer rollers 6*a* to 6*d* are made to press-contact with the intermediate transfer belt 8 in order along the moving direction (horizontal direction) of the intermediate transfer belt 8 (in order from the left side in FIG. 13 in this description). In this way, it is possible to effectively prevent the intermediate transfer belt 8 from being rapidly applied with a large load.

In addition, as described above, the difference among the separation distances W1 to W3 is larger than a pitch of the rack teeth of the rack 48. In this way, it is possible to prevent occurrence of vibrations two times in one pitch when the primary transfer rollers 6*a* to 6*c* are made to press-contact with the intermediate transfer belt 8, and hence it is possible to prevent the intermediate transfer unit 30 from generating large vibration.

In addition, when switching from the color mode to the monochrome mode (or the standby mode), the primary transfer rollers 6*a* to 6*c* separate from the intermediate transfer belt 8 with time differences, and hence a rapid change of load applied to the intermediate transfer belt 8 can be suppressed. In this way, also when switching to the monochrome mode (or the standby mode), the time until the rotation behavior of the intermediate transfer belt 8 is stabilized can be shortened.

Other than that, the present disclosure is not limited to the embodiments described above but can be variously modified within the scope of the present disclosure without deviating from the spirit thereof. For example, the arrangement order of the image forming portions Pa to Pd corresponding to the yellow, cyan, magenta, and black colors can be arbitrarily set. In addition, the embodiments described above adopt the structure in which the sandwiching portion 55*a* for sandwiching the first to fourth step ribs 50 to 53 is provided to the bearing holders 38*a* to 38*e*, so that the bearing holders 38*a* to 38*e* move upward and downward along the first to fourth step ribs 50 to 53. However, as shown in FIG. 15 for example, the sliders 37*a* and 37*b* may be provided with pressing ribs 90 to 93 including inclined portions 90*c* to 93*c*, and lower step portions 90*a* to 93*a* connected to lower ends of the inclined portions 90*c* to 93*c* and extended in the moving directions of the sliders 37*a* and 37*b*.

Figure 15:
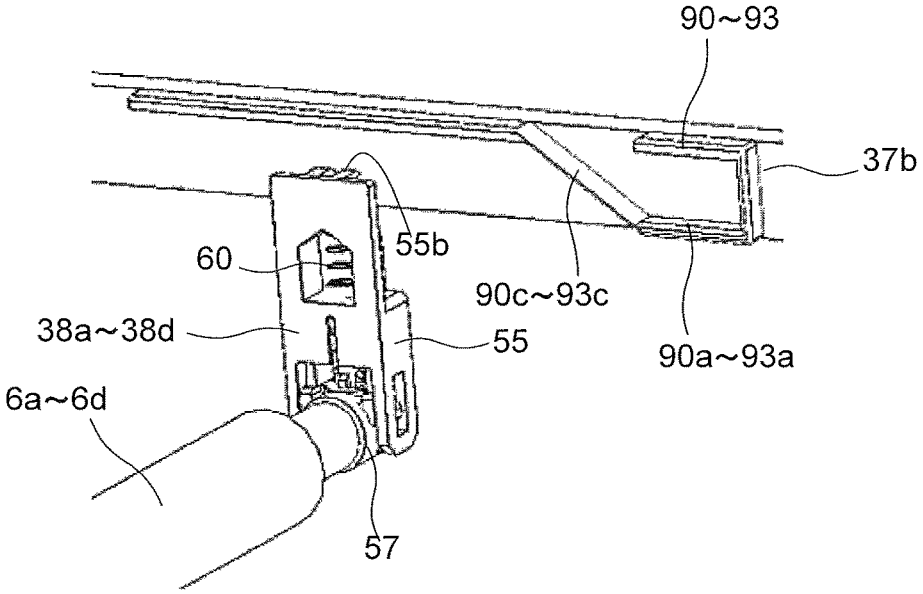
FIG. 15 is a perspective view showing another structure of a moving mechanism of the bearing holder and is a diagram showing an example in which a pressing rib is formed on the slider.

In this case, when the sliders 37*a* and 37*b* move in the left direction from the state of FIG. 15, contact portions 55*b* of the bearing holders 38*a* to 38*e* are pressed downward by the inclined portions 90*c* to 93*c* so as to move downward and are pressed by the lower step portions 90*a* to 93*a*, so that the primary transfer rollers 6*a* to 6*d* and the backup roller 33 are made to press-contact with the intermediate transfer belt 8. In addition, the sliders 37*a* and 37*b* move in the reverse direction (right direction) so that the contact portions 55*b* of the bearing holders 38*a* to 38*e* move from below the lower step portions 90*a* to 93*a* to the inclined portions 90*c* to 93*c*, and the bearing holders 38*a* to 38*e* separate from the pressing ribs 90 to 93, so that the primary transfer rollers 6*a* to 6*d* and the backup roller 33 separate from the intermediate transfer belt 8.

In addition, the color printer 100 is exemplified and described in this description as the image forming apparatus equipped with the intermediate transfer unit 30 according to the present disclosure, but the present disclosure can also be applied to various image forming apparatuses such as a color copier or a facsimile, which uses the transfer unit including the endless transfer belt and the plurality of transfer rollers. For example, the present disclosure can also be applied to a transfer unit mounted in a direct transfer type color image forming apparatus, which holds and conveys a paper sheet on the endless transfer belt, and individual color toner images formed by the image forming portions are directly transferred onto the paper sheet.

The present disclosure can be applied to a transfer unit including an endless transfer belt that moves along image forming portions and a plurality of transfer rollers that contact with or separate from the transfer belt. Using the present disclosure, it is possible to provide the transfer unit and the image forming apparatus, which can accurately switch positions of the plurality of transfer rollers with respect to the transfer belt with a simple structure.

What is claimed is:

1. A transfer unit comprising:

a transfer belt that is endless and moves along a plurality of image forming portions;

a plurality of transfer rollers respectively disposed to face image carriers disposed in the image forming portions, via the transfer belt, so as to transfer toner images formed on the image carriers onto the transfer belt or a recording medium held on the transfer belt;

a plurality of pairs of support members that support both end portions of rotation shafts of the plurality of transfer rollers in a rotatable manner and are capable of reciprocatingly moving in a contact or separate direction with respect to the transfer belt;

a pair of moving members that reciprocatingly move the support members in the contact or separate direction with respect to the transfer belt;

a pinion gear for transmitting a drive force to the moving member;

a sensor including a detection portion constituting of a light emission portion and a light reception portion; and a light shielding plate formed integrally to a gear for transmitting the drive force to the pinion gear, so as to block or open an optical path of the detection portion by rotation of the gear, wherein the light shielding plate includes a pulse portion in which a plurality of slits are formed at uniform intervals, and at least one of a light shielding portion and a light transmitting portion formed adjacent to the pulse portion, and a rotation amount of the gear is detected based on the number of the slits of the pulse portion that has passed the detection portion, and a reference position of the gear is detected based on timing when an edge of the light shielding portion passes the detection portion so as to block the optical path of the detection portion or timing when an edge of the light transmitting portion passes the detection portion so as to open the optical path of the detection portion.

2. The transfer unit according to claim 1, wherein the moving member is capable of switching among a standby mode in which all the transfer rollers are separated from the transfer belt, a first mode in which only one of the transfer rollers facing the image carrier disposed in specific one of the image forming portions is made to press-contact with the transfer belt, and a second mode in which all the transfer rollers are made to press-contact with the transfer belt, and when the reference position of the gear is detected based on timing when the edge of the light shielding portion passes the detection portion or timing when the edge of the light transmitting portion passes the detection portion, the rotation of the gear is stopped so that switching to the second mode or the standby mode is completed.

3. The transfer unit according to claim 2, wherein the light shielding plate includes the pulse portion, and the light shielding portion and the light transmitting portion that are formed adjacent to both ends of the pulse portion, and when the reference position of the gear is detected based on the timing when the edge of the light shielding portion passes the detection portion, the rotation of the gear is stopped so that switching to the second mode is completed, and switching to the first mode is completed based on timing when a predetermined number of slits of the pulse portion pass the detection portion, and switching to the standby mode is completed based on the timing when the edge of the light transmitting portion passes the detection portion.

4. The transfer unit according to claim 2, wherein the moving member is a pair of sliders that are supported to be movable in a reciprocating manner in parallel to a moving direction of the transfer belt, and support the support members to be movable in a reciprocating manner in the contact or separate direction with respect to the transfer belt, a side surface of the slider is provided with a plurality of step ribs including a lower step portion, an upper step portion parallel to the lower step portion, and an inclined portion connecting the lower step portion and the upper step portion, while the support member is provided with a sandwiching portion that sandwiches the step rib in a slidable manner, and the slider is moved in a reciprocating manner by rotation of the pinion gear so that the support members are positioned at the lower step portion or the upper step portion, and hence positions of the transfer rollers are switched to one of the first mode, the second mode, and the standby mode.

5. The transfer unit according to claim 2, wherein the moving members make all the transfer rollers, which are press-contacted with or separated from the transfer belt when switching between the first mode and the second mode or between the second mode and the standby mode, be in press-contact with or separate from the transfer belt at different timings from each other.

6. The transfer unit according to claim 5, wherein the transfer rollers are in press-contact with or separated from the transfer belt sequentially along a moving direction of the transfer belt.

7. The transfer unit according to claim 5, wherein the moving member is a pair of sliders that are supported to be movable in a reciprocating manner in parallel to the moving direction of the transfer belt, and support the support members to be movable in a reciprocating manner in the contact or separate direction with respect to the transfer belt, a side surface of the slider is provided with a plurality of step ribs including a lower step portion, an upper step portion parallel to the lower step portion, and an inclined portion connecting the lower step portion and the upper step portion, while the support member is provided with a sandwiching portion that sandwiches the step rib in a slidable manner, the slider is moved in a reciprocating manner by rotation of the pinion gear so that the support members are positioned at the lower step portion or the upper step portion, and hence positions of the transfer rollers are switched to one of the first mode, the second mode, and the standby mode, and separation distances in the horizontal direction between the support member and the inclined portion in the standby mode are different from each other.

8. The transfer unit according to claim 7, wherein the slider has a rack engaging with the pinion gear, and the difference of the separation distance between the support member and the inclined portion is larger than a pitch of rack teeth of the rack.

9. An image forming apparatus comprising the transfer unit according to claim 1.

* * * * *